US011170983B2

(12) United States Patent
Masuko et al.

(10) Patent No.: US 11,170,983 B2
(45) Date of Patent: Nov. 9, 2021

(54) ELECTRON MULTIPLIER THAT SUPPRESSES AND STABILIZES A VARIATION OF A RESISTANCE VALUE IN A WIDE TEMPERATURE RANGE

(71) Applicant: HAMAMATSU PHOTONICS K.K., Hamamatsu (JP)

(72) Inventors: Daichi Masuko, Hamamatsu (JP); Hajime Nishimura, Hamamatsu (JP); Yasumasa Hamana, Hamamatsu (JP); Hiroyuki Watanabe, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 89 days.

(21) Appl. No.: 16/623,517

(22) PCT Filed: Apr. 10, 2018

(86) PCT No.: PCT/JP2018/015085
§ 371 (c)(1),
(2) Date: Dec. 17, 2019

(87) PCT Pub. No.: WO2019/003568
PCT Pub. Date: Jan. 3, 2019

(65) Prior Publication Data

US 2021/0134572 A1 May 6, 2021

(30) Foreign Application Priority Data

Jun. 30, 2017 (JP) ..... JP2017-129433

(51) Int. Cl.
*H01J 43/24* (2006.01)

(52) U.S. Cl.
CPC ..... *H01J 43/246* (2013.01)

(58) Field of Classification Search
CPC ..... H01J 43/246
See application file for complete search history.

(56) References Cited

U.S. PATENT DOCUMENTS 4,849,000 A 7/1989 Patrick
5,514,928 A 5/1996 Niewold
(Continued)

FOREIGN PATENT DOCUMENTS

CN 101189701 A 5/2008
CN 104465295 A 3/2015
(Continued)

OTHER PUBLICATIONS

Scott M. Geyer et al., "Structural evolution of platinum thin films grown atomic layer deposition", Journal of Appli ed Physics, American Institute of Physics, US, vol. 116, No. 6, Aug. 14, 2014, p. 0021-p. 8979, XP01218872.
(Continued)

*Primary Examiner* — Joseph L Williams
(74) *Attorney, Agent, or Firm* — Faegre Drinker Biddle & Reath LLP

(57) ABSTRACT

The present embodiment relates to an electron multiplier having a structure configured to suppress and stabilize a variation of a resistance value in a wider temperature range. The electron multiplier includes a resistance layer sandwiched between a substrate and a secondary electron emitting layer and configured using a Pt layer two-dimensionally formed on a layer formation surface which is coincident with or substantially parallel to a channel formation surface of the substrate. The resistance layer has a temperature characteristic within a range in which a resistance value at −60° C. is 10 times or less, and a resistance value at +60° C. is 0.25 times or more, relative to a resistance value at a temperature of 20° C.

5 Claims, 6 Drawing Sheets

(56) References Cited

U.S. PATENT DOCUMENTS

| | | | | |
|---|---|---|---|---|
| 8,237,129 | B2 | 8/2012 | Sullivan et al. | |
| 9,064,676 | B2 | 6/2015 | Sullivan et al. | |
| 9,105,379 | B2 | 8/2015 | Elam et al. | |
| 10,727,035 | B2 * | 7/2020 | Masuko | H01J 43/246 |
| 11,011,358 | B2 * | 5/2021 | Masuko | H01J 43/24 |
| 2009/0315443 | A1 | 12/2009 | Sullivan et al. | |
| 2012/0187305 | A1 | 7/2012 | Elam et al. | |

FOREIGN PATENT DOCUMENTS

| | | | |
|---|---|---|---|
| CN | 104829411 | A | 8/2015 |
| JP | 2001-351509 | A | 12/2001 |
| JP | 2014-67545 | A | 4/2014 |
| JP | 2016-186939 | A | 10/2016 |
| RU | 2350446 | C2 | 4/2006 |
| RU | 2368978 | C2 | 5/2009 |
| WO | WO-2013/172417 | A1 | 11/2013 |

OTHER PUBLICATIONS

International Preliminary Report on Patentability dated Jan. 9, 2020 for PCT/JP2018/015085.

* cited by examiner

ELECTRON MULTIPLIER THAT SUPPRESSES AND STABILIZES A VARIATION OF A RESISTANCE VALUE IN A WIDE TEMPERATURE RANGE

TECHNICAL FIELD

The present invention relates to an electron multiplier that emits secondary electrons in response to incidence of the charged particles.

BACKGROUND ART

As electron multipliers having an electron multiplication function, electronic devices, such as an electron multiplier having channel and a micro-channel plate, (hereinafter referred to as "MCP") have been known. These are used in an electron multiplier tube, a mass spectrometer, an image intensifier, a photo-multiplier tube (hereinafter referred to as "PMT"), and the like. Lead glass has been used as a base material of the above electron multiplier. Recently, however, there has been a demand for an electron multiplier that does not use lead glass, and there is an increasing need to accurately form a film such as a secondary electron emitting surface on a channel provided on a lead-free substrate.

As techniques that enable such precise film formation control, for example, an atomic layer deposition method (hereinafter referred to as "ALD") is known, and an MCP (hereinafter, referred to as "ALD-MCP") manufactured using such a film formation technique is disclosed in the following Patent Document 1, for example. In the MCP of Patent Document 1, a resistance layer having a stacked structure in which a plurality of CZO (zinc-doped copper oxide nanoalloy) conductive layers are formed with an $Al_2O_3$ insulating layer interposed therebetween by an ALD method is employed as a resistance layer capable of adjusting a resistance value formed immediately below a secondary electron emitting surface. In addition, Patent Document 2 discloses a technique for generating a resistance film having a stacked structure in which insulating layers and a plurality of conductive layers comprised of W (tungsten) and Mo (molybdenum) are alternately arranged in order to generate a film whose resistance value can be adjusted by an ALD method.

CITATION LIST

Patent Literature

Patent Document 1: U.S. Pat. No. 8,237,129
Patent Document 2: U.S. Pat. No. 9,105,379

SUMMARY OF INVENTION

Technical Problem

The inventors have studied the conventional ALD-MCP in which a secondary electron emitting layer or the like is formed by the ALD method, and as a result, have found the following problems. That is, it has been found out, through the study of the inventors, that the ALD-MCP using the resistance film formed by the ALD method does not have an excellent temperature characteristic of a resistance value as compared to the conventional MCP using the Pb (lead) glass although stated in neither of the above Patent Documents 1 and 2. In particular, there is a demand for development of an ALD-MCP that enables a wide range of a use environment temperature of a PMT incorporating an image intensifier and an MCP from a low temperature to a high temperature and reduces the influence of an operating environment temperature.

Incidentally, one of factors affected by the operating environment temperature of the MCP is the above-described temperature characteristic (resistance value variation in the MCP). Such a temperature characteristic is an index indicating how much a current (strip current) flowing in the MCP varies depending on an outside air temperature at the time of using the MCP. As the temperature characteristic of the resistance value becomes more excellent, the variation of the strip current flowing through the MCP becomes smaller when the operating environment temperature is changed, and the use environment temperature of the MCP becomes wider.

The present invention has been made to solve the above-described problems, and an object thereof is to provide an electron multiplier having a structure to suppress and stabilize a resistance value variation in a wider temperature range.

Solution to Problem

In order to solve the above-described problems, an electron multiplier according to the present embodiment is applicable to an electronic device, such as a micro-channel plate (MCP), and a channeltron, where a secondary electron emitting layer and the like constituting an electron multiplication channel is formed using an ALD method, and includes at least a substrate, a secondary electron emitting layer, and a resistance layer. The substrate has a channel formation surface on which the secondary electron emitting layer, the resistance layer, and the like are stacked. The secondary electron emitting surface has a bottom surface facing the channel formation surface, and a secondary electron emitting surface that opposes the bottom surface and emits secondary electrons in response to incidence of charged particles. The resistance layer is a layer sandwiched between the substrate and the secondary electron emitting layer, and includes a Pt (platinum) layer in which a plurality of Pt particles whose resistance values have positive temperature characteristics are two-dimensionally arranged in the state of being separated from each other on a layer formation surface that is coincident with or substantially parallel to the channel formation surface. In this configuration, the resistance layer preferably has a temperature characteristic within a range in which a resistance value at −60° C. is 10 times or less, and a resistance value at +60° C. is 0.25 times or more, relative to a resistance value at a temperature of 20° C.

Incidentally, each embodiment according to the present invention can be more sufficiently understood from the following detailed description and the accompanying drawings. These examples are given solely for the purpose of illustration and should not be considered as limiting the invention.

In addition, a further applicable scope of the present invention will become apparent from the following detailed description. Meanwhile, the detailed description and specific examples illustrate preferred embodiments of the present invention, but are given solely for the purpose of illustration, and it is apparent that various modifications and improvements within the scope of the present invention are obvious to those skilled in the art from this detailed description.

Advantageous Effects of Invention

According to the present embodiment, it is possible to effectively improve the temperature characteristic of the resistance value in the resistance layer by configuring the resistance layer formed immediately below the secondary electron emitting layer so as to include the Pt layer in which the plurality of metal particles comprised of the metal material whose resistance value has the positive temperature characteristic, such as Pt, are two-dimensionally arranged in the state of being separated from each other.

DESCRIPTION OF EMBODIMENTS

Figure 1A:
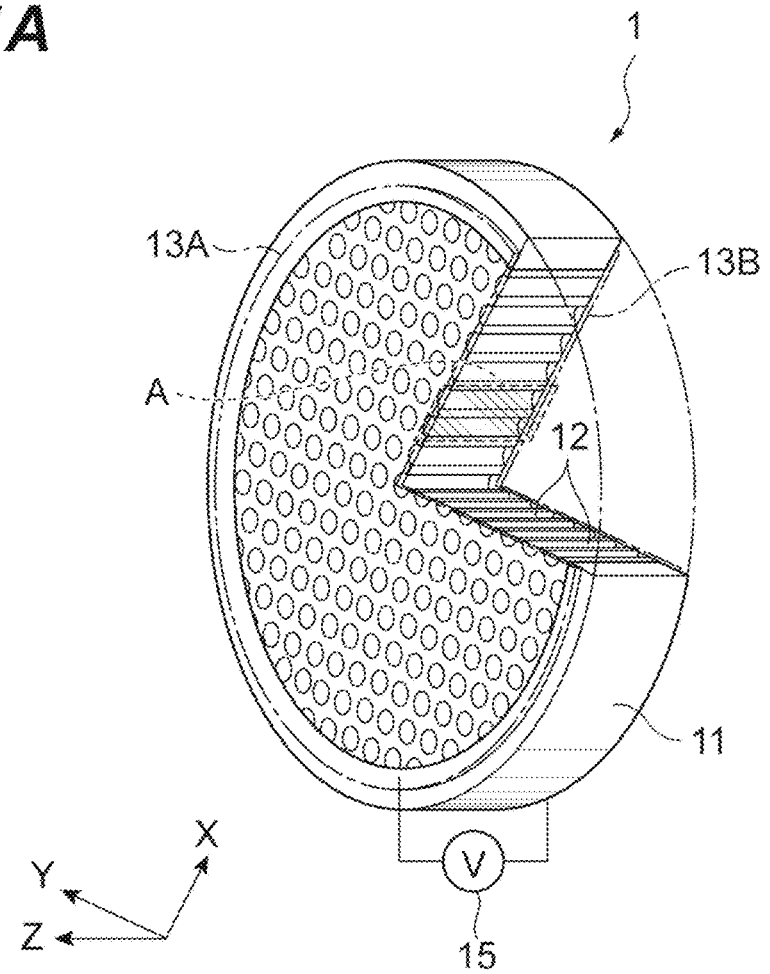
FIGS. 1A and 1B are views illustrating structures of various electronic devices to which an electron multiplier according to the present embodiment can be applied.

Description of Embodiment of Invention of Present Application

First, contents of an embodiment of the invention of the present application will be individually listed and described.

(1) As one aspect of an electron multiplier according to the present embodiment is applicable to an electronic device, such as a micro-channel plate (MCP), and a channeltron, where a secondary electron emitting layer and the like constituting an electron multiplication channel is formed using an ALD method, and includes at least a substrate, a secondary electron emitting layer, and a resistance layer. The substrate has a channel formation surface on which the secondary electron emitting layer, the resistance layer, and the like are stacked. The secondary electron emitting layer is comprised of a first insulating material, and has a bottom surface facing the channel formation surface and a secondary electron emitting surface which opposes the bottom surface and emits secondary electrons in response to incidence of the charged particles. The resistance layer is a layer sandwiched between the substrate and the secondary electron emitting layer, and includes a Pt layer in which a plurality of Pt particles, which serve as materials whose resistance values have positive temperature characteristics, are two-dimensionally arranged in the state of being separated from each other on a layer formation surface that is coincident with or substantially parallel to the channel formation surface. In particular, the resistance layer has a temperature characteristic within a range in which a resistance value of the resistance layer at −60° C. is 10 times or less, and a resistance value of the resistance layer at +60° C. is 0.25 times or more, relative to a resistance value of the resistance layer at a temperature of 20° C.

In particular, the resistance layer includes one or more Pt layers in which a plurality of Pt particles, which serve as metal particles comprised of a metal material whose resistance value has a positive temperature characteristic, are two-dimensionally arranged on a layer formation surface, which is coincident with or substantially parallel to the channel formation surface, in the state of being adjacent to each other with a part (insulating material) of the secondary electron emitting layer arranged above the resistance layer interposed therebetween. In addition, the "metal particle" in the present specification means a metal piece arranged in the state of being completely surrounded by an insulating material and each exhibiting clear crystallinity when the layer formation surface is viewed from the secondary electron emitting layer side.

(2) As one aspect of the present embodiment, the resistance layer preferably has a temperature characteristic within a range in which a resistance value of the resistance layer at −60° C. is 2.7 times or less, and a resistance value of the resistance layer at +60° C. is 0.3 times or more, relative to a resistance value of the resistance layer at a temperature of 20° C.

(3) As one aspect of the present embodiment, each of the Pt particles constituting the Pt layer preferably has crystallinity to such an extent that a peak on the (111) plane and a peak on the (200) plane at which a full width at half maximum is an angle of 5° or less appear in a spectrum obtained by XRD analysis. Further, as one aspect of the present embodiment, each of the Pt particles constituting the Pt layer preferably has crystallinity such an extent that a peak on the (220) plane at which a full width at half maximum is an angle of 5° or less further appears in the spectrum obtained by XRD analysis.

(4) As an aspect of the present embodiment, the electron multiplier may include an underlying layer provided between the substrate and the secondary electron emitting layer. In this case, the underlying layer is comprised of a second insulating material and has a layer formation surface on which a Pt layer is two-dimensionally arranged at a position facing the bottom surface of the secondary electron emitting layer. Incidentally, the second insulating material may be the same as or different from the first insulating material.

As described above, each aspect listed in [Description of Embodiment of Invention of Present Application] can be applied to each of the remaining aspects or to all the combinations of these remaining aspects.

Details of Embodiment of Invention of Present Application

Specific examples of the electron multiplier according to the present invention will be described hereinafter in detail with reference to the accompanying drawings. Incidentally, the present invention is not limited to these various examples, but is illustrated by the claims, and equivalence of and any modification within the scope of the claims are intended to be included therein. In addition, the same elements in the description of the drawings will be denoted by the same reference signs, and redundant descriptions will be omitted.

Figure 1B:
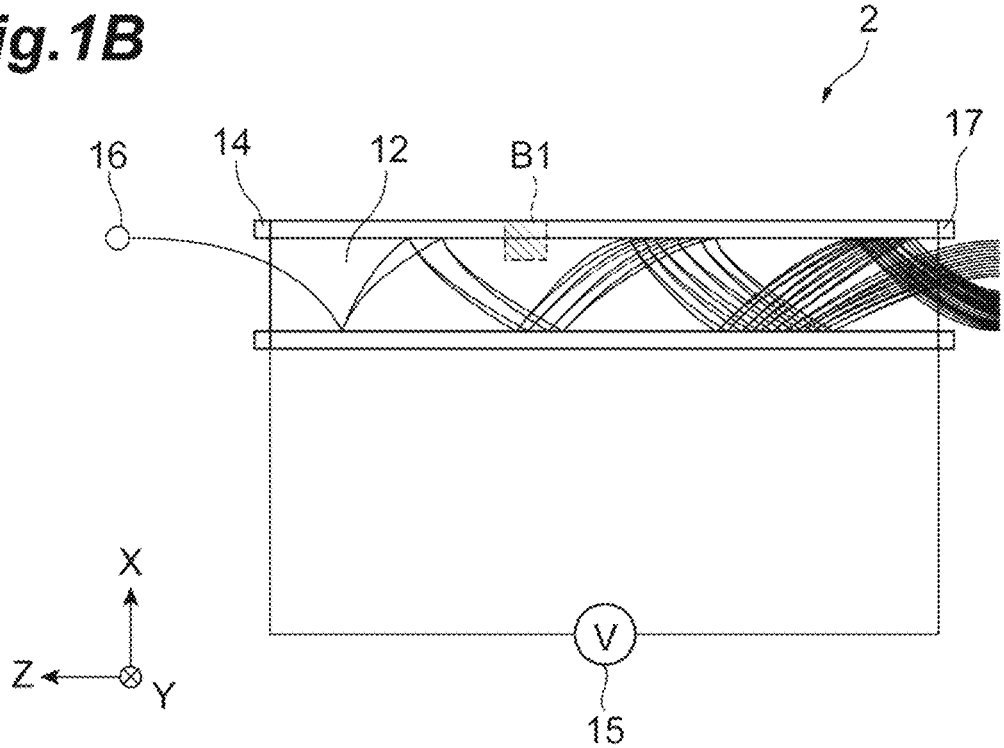

FIGS. 1A and 1B are views illustrating structures of various electronic devices to which the electron multiplier according to the present embodiment can be applied. Specifically, FIG. 1A is a partially broken view illustrating a typical structure of an MCP to which the electron multiplier according to the present embodiment can be applied, and FIG. 1B is a cross-sectional view of a channeltron to which the electron multiplier according to the present embodiment can be applied.

An MCP 1 illustrated in FIG. 1A includes: a glass substrate that has a plurality of through-holes functioning as channels 12 for electron multiplication; an insulating ring 11 that protects a side surface of the glass substrate; an input-side electrode 13A that is provided on one end face of the glass substrate; and an output-side electrode 13B that is provided on the other end face of the glass substrate. Incidentally, a predetermined voltage is applied by a voltage source 15 between the input-side electrode 13A and the output-side electrode 13B.

In addition, a channeltron 2 of FIG. 1B includes: a glass tube that has a through-hole functioning as the channel 12 for electron multiplication; an input-side electrode 14 that is provided at an input-side opening portion of the glass tube; and an output-side electrode 17 that is provided at an output-side opening portion of the glass tube. Incidentally, a predetermined voltage is applied by the voltage source 15 between the input-side electrode 14 and the output-side electrode 17 even in the channeltron 2. When a charged particle 16 is incident into the channel 12 from the input-side opening of the channeltron 2 in a state where the predetermined voltage is applied between the input-side electrode 14 and the output-side electrode 17, a secondary electron is repeatedly emitted in response to the incidence of the charged particle 16 in the channel 12 (cascade multiplication of secondary electrons). As a result, the secondary electrons that have been cascade-multiplied in the channel 12 are emitted from an output-side opening of the channeltron 2. This cascade multiplication of secondary electrons is also performed in each of the channels 12 of the MCP illustrated in FIG. 1A.

Figure 2A:
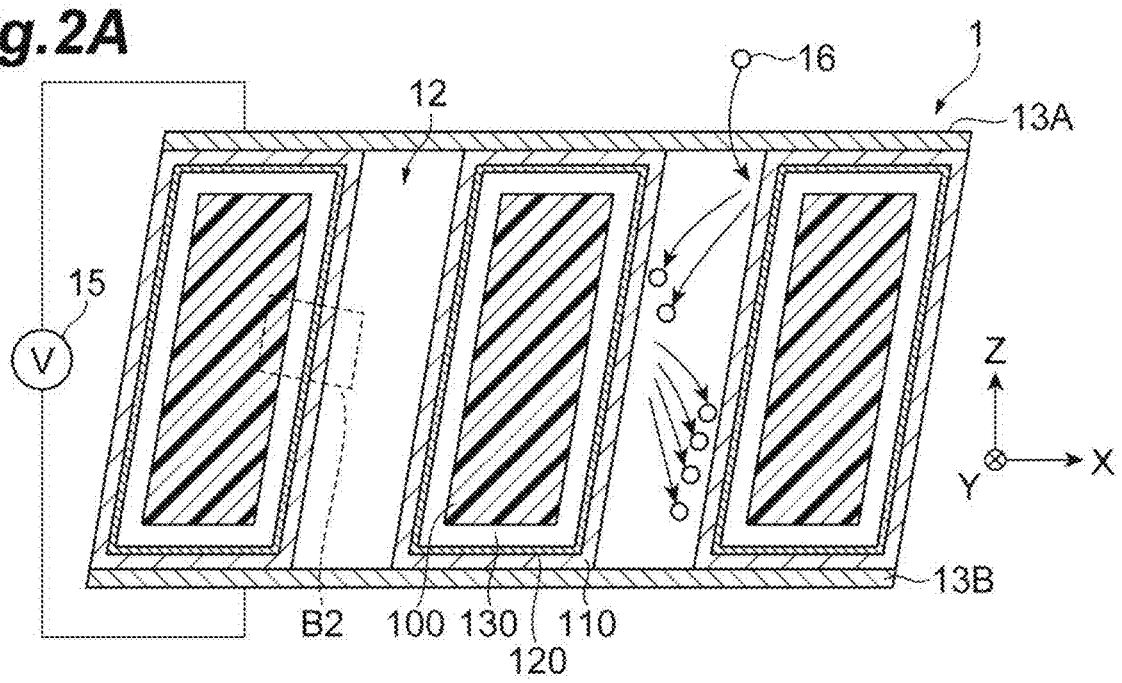
FIGS. 2A to 2C are views illustrating examples of various cross-sectional structures of electron multipliers according to the present embodiment and a comparative example, respectively.
Figure 2B:
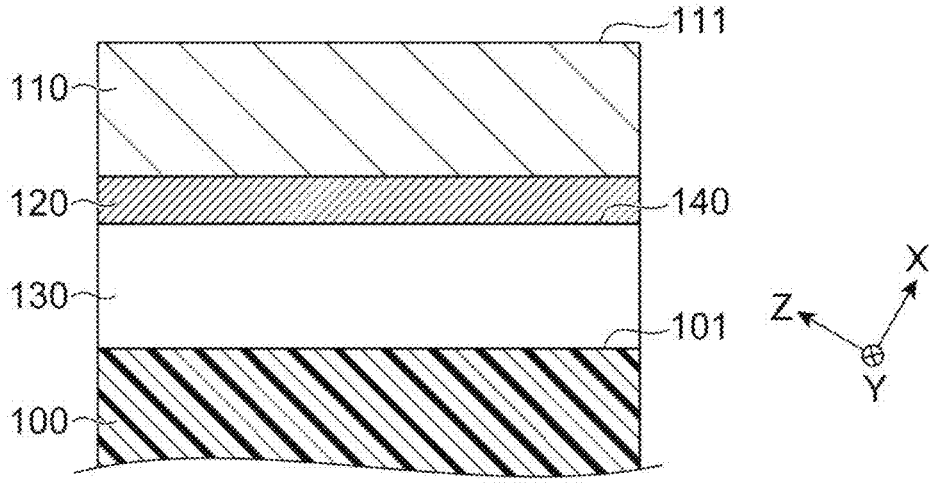
Figure 2C:
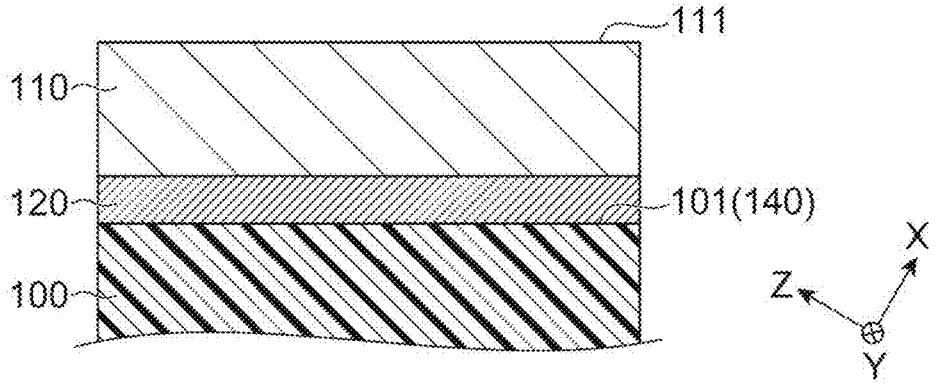

FIG. 2A is an enlarged view of a part (a region A indicated by a broken line) of the MCP 1 illustrated in FIGS. 1A and 1B. FIG. 2B is a view illustrating a cross-sectional structure of a region B2 illustrated in FIG. 2A, and is the view illustrating an example of a cross-sectional structure of the electron multiplier according to the present embodiment. In addition, FIG. 2C is a view illustrating a cross-sectional structure of the region B2 illustrated in FIG. 2A similarly to FIG. 2B, and is the view illustrating another example of the cross-sectional structure of the electron multiplier according to the present embodiment. Incidentally, the cross-sectional structures illustrated in FIGS. 2B and 2C are substantially coincident with the cross-sectional structure in the region B1 of the channeltron 2 illustrated in FIG. 1B (however, coordinate axes illustrated in FIG. 1B are inconsistent with coordinate axes in each of FIGS. 2B and 2C).

As illustrated in FIG. 2B, an example of the electron multiplier according to the present embodiment is constituted by: a substrate 100 comprised of glass or ceramic; an underlying layer 130 provided on a channel formation surface 101 of the substrate 100; a resistance layer 120 provided on a layer formation surface 140 of the underlying layer 130; and a secondary electron emitting layer 110 that has a secondary electron emitting surface 111 and is arranged so as to sandwich the resistance layer 120 together with the underlying layer 130. Here, the secondary electron emitting layer 110 is comprised of a first insulating material such as $Al_2O_3$ and MgO. It is preferable to use MgO having a high secondary electron emission capability in order to improve a gain of the electron multiplier. The underlying layer 130 is comprised of a second insulating material such as $Al_2O_3$ and $SiO_2$. The resistance layer 120 sandwiched between the underlying layer 130 and the secondary electron emitting layer 110 includes a metal layer, constituted by metal particles whose resistance values have positive temperature characteristics and which have sizes to such an extent as to exhibit clear crystallinity and an insulating material (a part of the secondary electron emitting layer 110) filling a portion between the metal particles, on the layer formation surface 140 of the underlying layer 130.

The resistance layer 120 may include a plurality of metal layers. That is, the resistance layer 120 may have a multi-layer structure in which a plurality of metal layers are provided between the substrate 100 and the secondary electron emitting layer 110 with an insulating material (functioning as an underlying layer having a layer formation surface) interposed therebetween. However, a resistance layer having a single-layer structure in which the number of the resistance layers 120 existing between the channel formation surface 101 of the substrate 100 and the secondary electron emitting surface 111 is limited to one will be described as an example hereinafter in order to simplify the description.

Figure 6A:
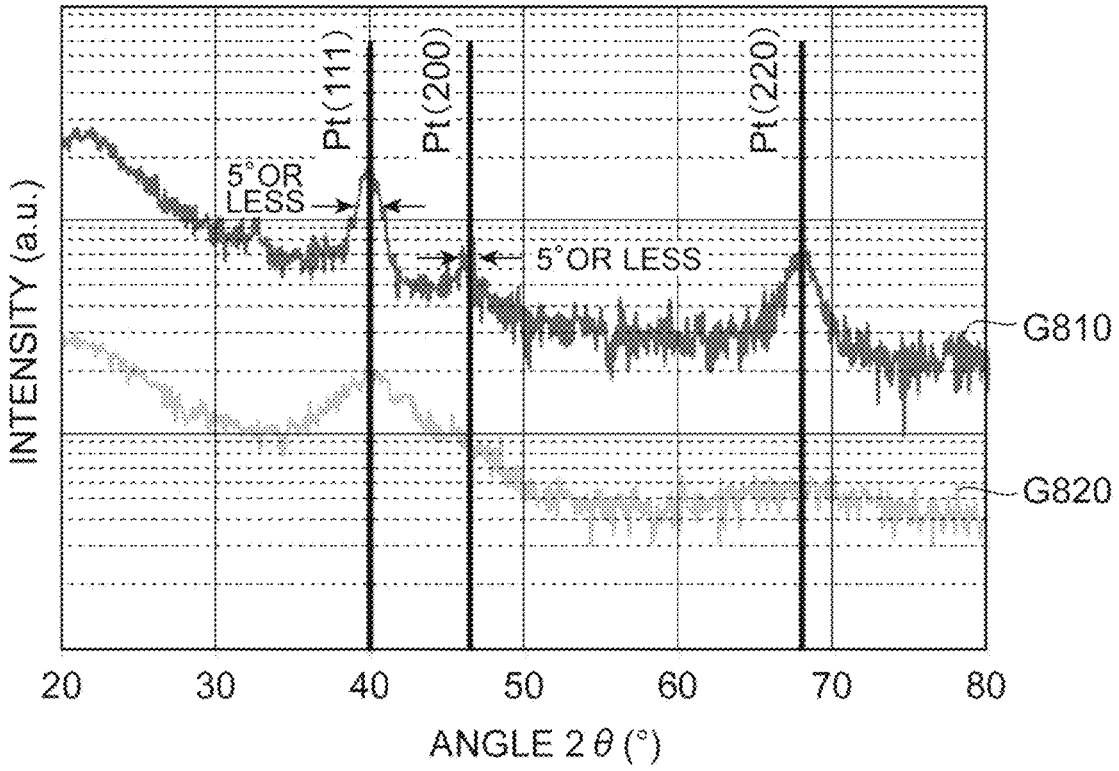
FIGS. 6A and 6B are spectra, obtained by x-ray diffraction (XRD) analysis, of each of a measurement sample corresponding to the electron multiplier according to the present embodiment, a measurement sample corresponding to the electron multiplier according to the comparative example, and the MCP sample applied to the electron multiplier according to the present embodiment.
Figure 6B:
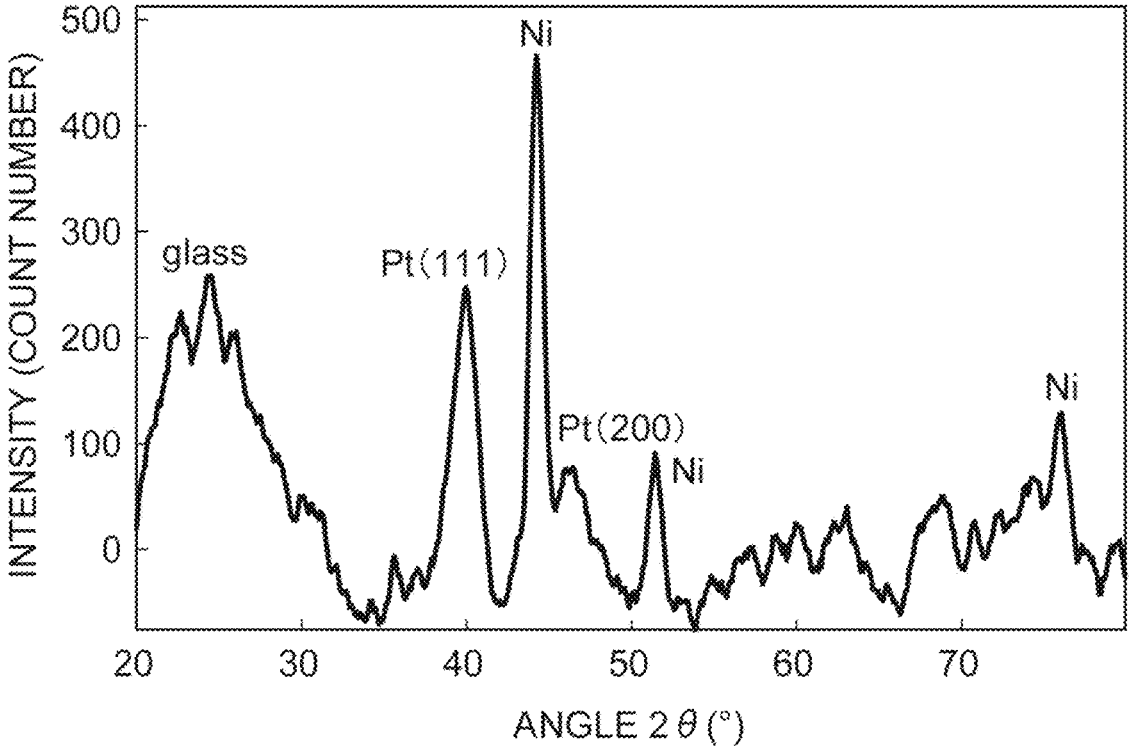

A material constituting the resistance layer 120 is preferably a material whose resistance value has a positive temperature characteristic such as Pt. Here, the crystallinity of the metal particle can be confirmed with a spectrum obtained by XRD analysis. For example, when the metal particle is a Pt particle, a spectrum having a peak at which a full width at half maximum has an angle of 5° or less in at least the (111) plane and the (200) plane is obtained in the present embodiment as illustrated in FIG. 6A. In FIGS. 6A and 6B, the (111) plane of Pt is indicated by Pt(111), and the (200) plane of Pt is indicated by Pt(200).

Incidentally, the presence of the underlying layer 130 illustrated in FIG. 2B has no influence on the temperature dependence of the resistance value in the entire electron multiplier. Therefore, the structure of the electron multiplier according to the present embodiment is not limited to the example of FIG. 2B, and may have the cross-sectional structure as illustrated in FIG. 2C. The cross-sectional structure illustrated in FIG. 2C is different from the cross-sectional structure illustrated in FIG. 2B in terms that no underlying layer is provided between the substrate 100 and the secondary electron emitting layer 110. The channel formation surface 101 of the substrate 100 functions as the layer formation surface 140 on which the resistance layer 120 is formed. The other structures in FIG. 2C are the same as those in the cross-sectional structure illustrated in FIG. 2B.

In the following description, a configuration (example of a single Pt layer) in which Pt is applied as a material whose resistance values have positive temperature characteristics and which constitute the resistance layer 120 will be stated.

Figure 3A:
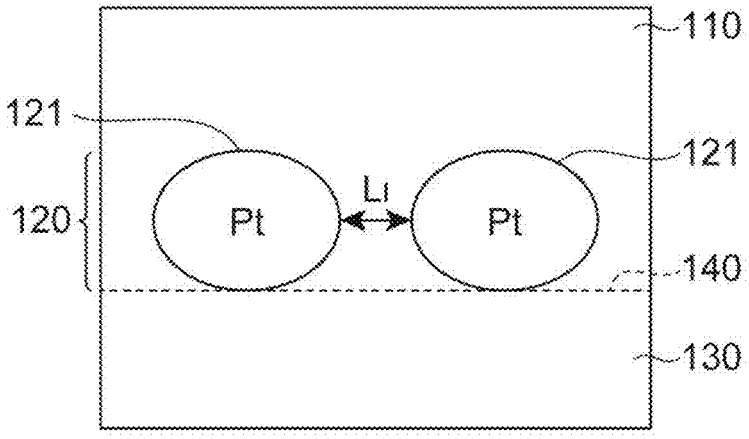
FIGS. 3A to 3C are views for quantitatively describing a relationship between a temperature and an electrical conductivity in the electron multiplier according to the present embodiment, particularly the resistance layer.
Figure 3B:
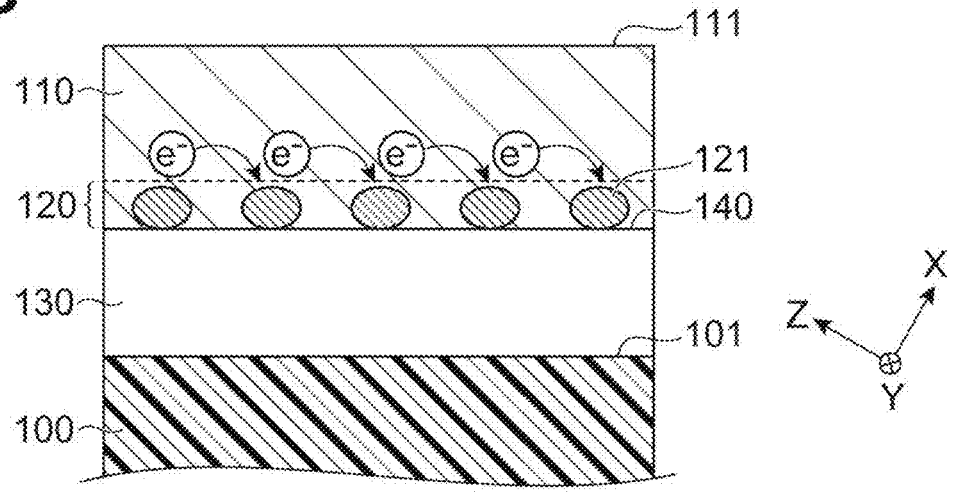
Figure 3C:
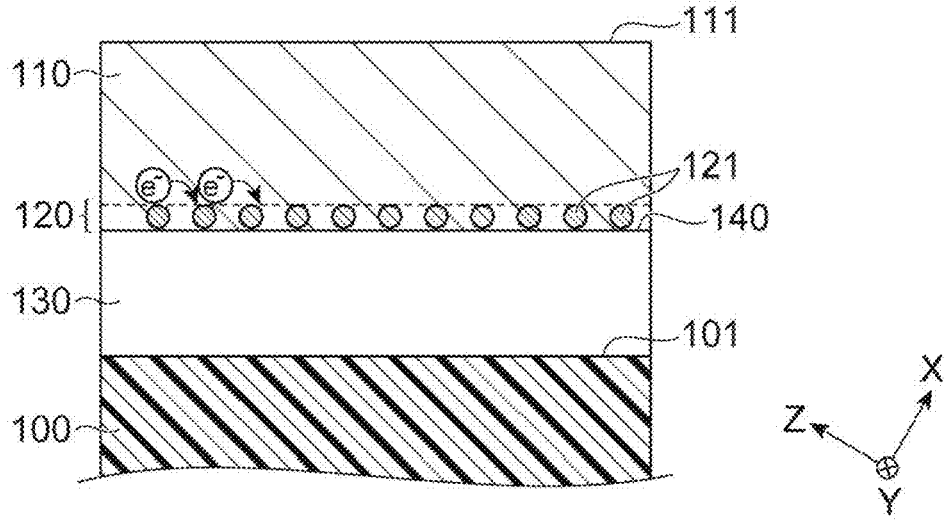

FIGS. 3A to 3C are views for quantitatively describing a relationship between a temperature and an electrical conductivity in the electron multiplier according to the present embodiment, particularly the resistance layer. In particular, FIG. 3A is a schematic view for describing an electron conduction model in a single Pt layer (the resistance layer 120) formed on the layer formation surface 140 of the underlying layer 130. In addition, FIG. 3B illustrates an example of a cross-sectional model of the electron multiplier according to the present embodiment, and FIG. 3C illustrates another example of a cross-sectional model of the electron multiplier according to the present embodiment.

In the electron conduction model illustrated in FIG. 3A, Pt particles 121 constituting the single Pt layer (included in the resistance layer 120) are arranged as non-localized regions where free electrons can exist on the layer formation surface 140 of the underlying layer 130 to be spaced by a distance $L_I$ with a localized region where no free electron exists (for example, a part of the secondary electron emitting layer 110 in contact with the layer formation surface 140 of the underlying layer 130) interposed therebetween. In addition, an example of a cross-sectional structure of the model defined as the electron multiplier according to the present embodiment is constituted by: the substrate 100; the underlying layer 130 provided on the channel formation surface 101 of the substrate 100; the resistance layer 120 provided on the layer formation surface 140 of the underlying layer 130; and the secondary electron emitting layer (insulating material) 110 that has the secondary electron emitting surface 111 and is arranged so as to sandwich the resistance layer 120 together with the underlying layer 130 as illustrated in FIG. 3B. FIG. 3C illustrates another example of the cross-sectional structure of the model assumed as the electron multiplier according to the present embodiment. The example of FIG. 3C has the same cross-sectional structure as the cross-sectional structure illustrated in FIG. 3B but is different from the example of FIG. 3B in terms that each size of the Pt particles 121 constituting the resistance layer 120 is small and an interval between the adjacent Pt particles 121 is narrow.

Figure 4:
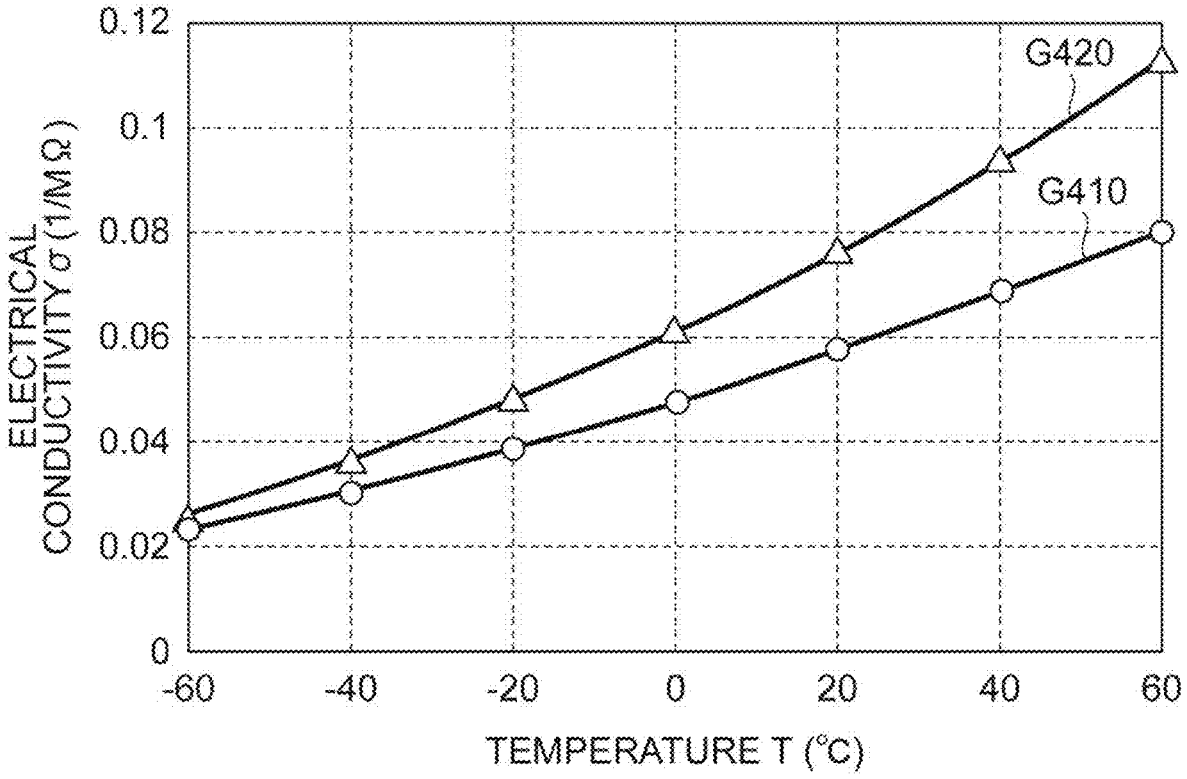
FIG. 4 is a graph illustrating temperature dependence of the electrical conductivity for each sample including a single Pt layer having a different thickness as the resistance layer.

Each Pt layer formed on the substrate 100 is filled with an insulating material (for example, MgO or $Al_2O_3$) between Pt particles having any energy level among a plurality of discrete energy levels, and free electrons in a certain Pt particle 121 (non-localized region) moves to the adjacent Pt particle 121 via the insulating material (localized region) by the tunnel effect (hopping). In such a two-dimensional electron conduction model, an electrical conductivity (reciprocal of resistivity) σ with respect to a temperature T is given by the following formula. Incidentally, the following is limited to the two-dimensional electron conduction model in order to study the hopping inside the layer formation surface 140 in which the plurality of Pt particles 121 are two-dimensionally arranged on the layer formation surface 140.

$$\sigma = \sigma_0 \exp\left(-\left(\frac{T_0}{T}\right)^{\frac{1}{3}}\right)$$

$$T_0 = \frac{3}{k_B N(E_F) L_I^2}$$

σ: electrical conductivity
$\sigma_0$: electrical conductivity at T=∞
T: temperature (K)
$T_0$: temperature constant
$k_B$: Boltzmann coefficient
$N(E_F)$: state density
$L_I$: distance (m) between non-localized regions FIG. 4 is a graph in which actual measurement values of a plurality of samples actually measured are plotted together with fitting function graphs (G410 and G420) obtained based on the above formula. Incidentally, in FIG. 4, the graph G410 indicates the electrical conductivity a of a sample in which a Pt layer whose thickness is adjusted to a thickness corresponding to 7 "cycles" by ALD is formed on the layer formation surface 140 of the underlying layer 130 comprised of $Al_2O_3$ and $Al_2O_3$ (the secondary electron emitting layer 110) adjusted to a thickness corresponding to 20 "cycles" is formed by ALD, and a symbol "o" is an actual measurement value thereof. Incidentally, the unit "cycle" is an "ALD cycle" that means the number of atom implantations by ALD. It is possible to control a thickness of an atomic layer to be formed by adjusting this "ALD cycle". In addition, the graph G420 indicates the electrical conductivity a of a sample in which a Pt layer whose thickness is adjusted to a thickness corresponding to 6 "cycles" by ALD is formed on the layer formation surface 140 of the underlying layer 130 comprised of $Al_2O_3$ and $Al_2O_3$ (the secondary electron emitting layer 110) adjusted to a thickness corresponding to 20 "cycles" is formed by ALD, and a symbol "A" is an actual measurement value thereof. As can be understood from the graphs G410 and G420 in FIG. 4, it is possible to understand that the temperature characteristic is improved in terms of the resistance value of the resistance layer 120 when the thickness of the resistance layer 120 (specified by the average thickness of the Pt particles 121 along the stacking direction) is set to be thicker even if the Pt particles 121 constituting the resistance layer 120 are arranged in a plane. Incidentally, the "average thickness" of the Pt particles in the present specification means a thickness of a film when a plurality of metal particles two-dimensionally arranged on the layer formation surface are fainted into a flat film shape.

Qualitatively, only the single Pt layer is formed between the channel formation surface 101 of the substrate 100 and the secondary electron emitting surface 111 in the case of the model of the electron multiplier according to the present embodiment illustrated in FIG. 3B. That is, in the present embodiment, the Pt particle 121 having such a crystallinity that enables confirmation of the peak at which the full width at half maximum has the angle of 5° or less is formed on the layer formation surface 140 at least in the (111) plane and the (200) plane in the spectrum obtained by XRD analysis. In this manner, a conductive region is limited within the layer formation surface 140, and the number of times of hopping of free electrons moving between the Pt particles 121 by the tunnel effect is small in the present embodiment.

Meanwhile, in the case of the model illustrated in FIG. 3C, the resistance layer 120 has a structure in which the plurality of Pt particles 121 each of which has a small size and has a narrow interval between the adjacent Pt particles 121 are two-dimensionally arranged as compared to the example of FIG. 3B. In particular, the number of times of hopping of free electrons moving between the adjacent Pt particles 121 increases in the structure in which the plurality of Pt particles 121 that are small and have the narrow interval are two-dimensionally arranged. As a result, the temperature characteristic relative to the resistance value tends to deteriorate in the example of FIG. 3C as compared to the example of FIG. 3B.

Next, a description will be given regarding comparison results between an MCP sample to which the electron multiplier according to the present embodiment is applied and an MCP sample to which the electron multiplier according to the comparative example is applied with reference to FIGS. 5, 6A and 6B.

Among prepared first to third samples, the first sample has a structure in which an underlying layer comprised of $Al_2O_3$, a single Pt layer, and a secondary electron emitting layer comprised of $Al_2O_3$ are stacked in this order on a substrate. A thickness of the underlying layer of the first sample is adjusted to 100 [cycle] by ALD, a thickness of the Pt layer is adjusted to 14 [cycle] by ALD, and a thickness of the secondary electron emitting layer is adjusted to 68 [cycle] by ALD. The single Pt layer (resistance layer 120) has a structure in which a portion between the Pt particles 121 is filled with an insulating material (a part of the secondary electron emitting layer). The second sample has a structure in which a stacked structure (the resistance layer 120) having ten sets of an underlying layer and a Pt layer each comprised of $Al_2O_3$ and a secondary electron emitting layer comprised of $Al_2O_3$ are stacked in this order on a substrate. In each set constituting the stacked structure of the second sample, a thickness of the underlying layer comprised of $Al_2O_3$ is adjusted to 20 [cycle] by ALD, and a thickness of the Pt layer is adjusted to 5 [cycle] by ALD. In addition, a thickness of the secondary electron emitting layer is adjusted to 68 [cycle] by ALD. Each of the Pt layers has a structure in which an insulating material fills a portion between the Pt particles 121. The third sample, which is a comparative example, has a structure in which a stacked structure (the resistance layer 120) having 48 sets of an underlying layer comprised of $Al_2O_3$ and a $TiO_2$ layer, and a secondary electron emitting layer comprised of $Al_2O_3$ are stacked in this order on a substrate. In each set constituting the stacked structure of the third sample, a thickness of the underlying layer comprised of $Al_2O_3$ is adjusted to 3 [cycle] by ALD, and a thickness of the $TiO_2$ layer is adjusted to 2 [cycle] by ALD. In addition, a thickness of the secondary electron emitting layer is adjusted to 38 [cycle] by ALD.

Figure 5:
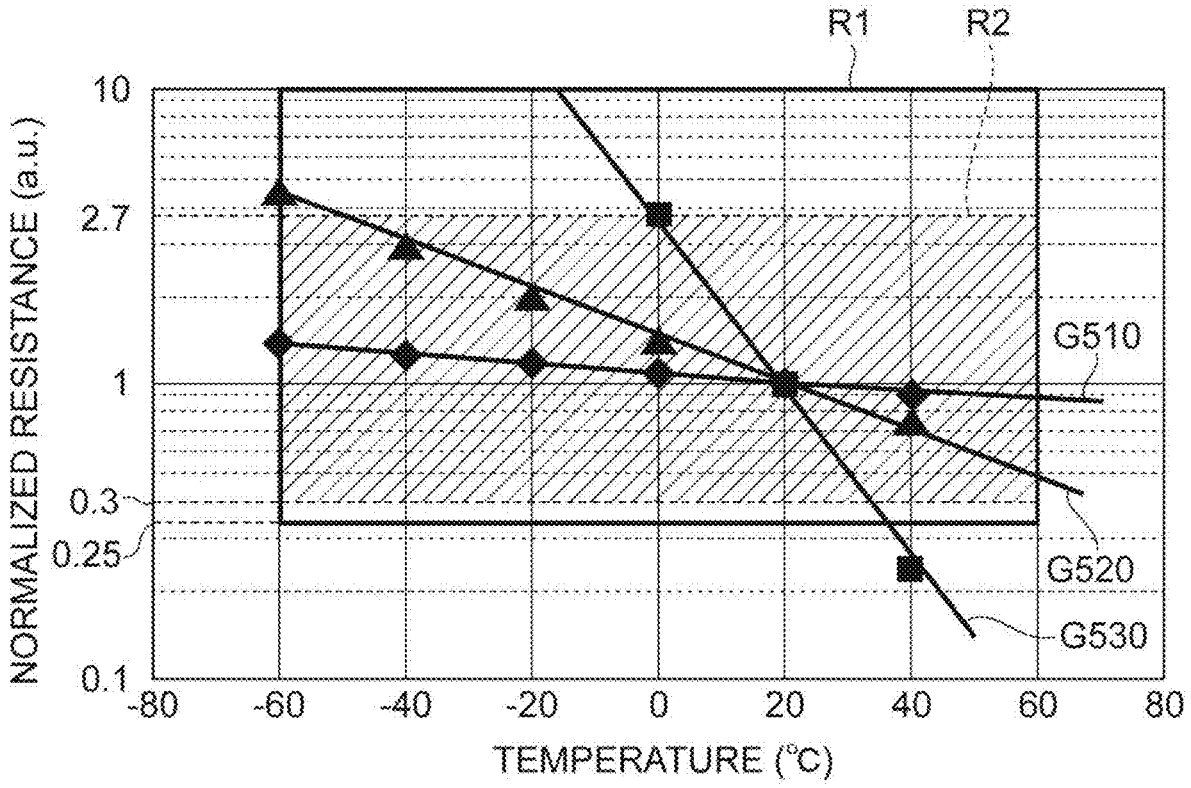
FIG. 5 is a graph illustrating temperature characteristic (in n operation with 800 V) of a normalization resistance in each of an MCP sample to which the electron multiplier according to the present embodiment is applied and an MCP sample to which the electron multiplier according to the comparative example is applied.

FIG. 5 is a graph illustrating temperature characteristic of a normalized resistance (at the time of an operation with 800 V) in each of the first and second samples of the present embodiment and the third sample of the comparative example having the above-described structures. Specifically, in FIG. 5, a graph G510 indicates the temperature dependence of the resistance value in the first sample, a graph G520 indicates the temperature dependence of the resistance value in the second sample, and a graph G530 indicates the temperature dependence of the resistance value in the third sample. As can be seen from FIG. 5, a slope of the graph G520 is smaller than a slope of the graph G530, and a slope of the graph G510 is even smaller than the slope of the graph G530. That is, when the resistance layer 120 has a multilayer structure including a single Pt layer or a plurality of Pt layers, the temperature dependence of the resistance value is improved as compared to a resistance layer including a metal layer comprised of another metal material. Further, in the case of a resistance layer including only a single Pt layer even in the configuration in which the resistance layer 120 includes the Pt layer, the temperature dependence of the resistance value is further improved (the slope of the graph is reduced) as compared to the resistance layer having the multilayer structure configured using the plurality of Pt layers. In this manner, according to the present embodiment, the temperature characteristic is stabilized in a wider temperature range than the comparative example. Specifically, when considering an application of the electron multiplier according to the present embodiment to a technical field such as mass spectrometry, the allowable temperature dependence, for example, is a range (region R1 illustrated in FIG. 5) in which a resistance value at −60° C. is 10 times or less and a resistance value at +60° C. is 0.25 times or more with a resistance value at a temperature of 20° C. as a reference. When considering an application of the electron multiplier according to the present embodiment to a technical field such as an image intensifier, it is preferable that the allowable temperature dependence be a range (shaded region R2 illustrated in FIG. 5) in which a resistance value at −60° C. is 2.7 times or less and a resistance value at +60° C. is 0.3 times or more with a resistance value at a temperature of 20° C. as a reference.

FIG. 6A illustrates a spectrum obtained by XRD analysis of each of a sample in which a film equivalent to the film formation for MCP (the model of FIG. 3B using the Pt layer) is formed on a glass substrate as a measurement sample corresponding to the electron multiplier according to the present embodiment and a sample in which a film equivalent to the film formation for MCP (the model of FIG. 3C using the Pt layer) is formed on a glass substrate as a measurement sample corresponding to the electron multiplier according to the comparative example. On the other hand, FIG. 6B is a spectrum obtained by XRD analysis of the MCP sample of the present embodiment having the above-described structure. Specifically, in FIG. 6A, a spectrum G810 indicates an XRD spectrum of the measurement sample of the present embodiment, and a spectrum G820 indicates an XRD spectrum of the measurement sample of the comparative example. On the other hand, FIG. 6B is the XRD spectrum of the MCP sample of the present embodiment after removing an electrode of an Ni—Cr alloy (Inconel: registered trademark). Incidentally, as spectrum measurement conditions illustrated in FIGS. 6A and 6B, an X-ray source tube voltage was set to 45 kV, a tube current was set to 200 mA, an X-ray incident angle was set to 0.3°, an X-ray irradiation interval was set to 0.1°, X-ray scanning speed was set to 5°/min, and a length of an X-ray irradiation slit in the longitudinal direction was set to 5 mm.

In FIG. 6A, a peak at which a full width at half maximum has an angle of 5° or less appears in each of the (111) plane, the (200) plane, and the (220) plane in the spectrum G810 of the measurement sample of the present embodiment. On the other hand, a peak appears only in the (111) plane in the spectrum G820 of the measurement sample of the comparative example, but the full width at half maximum at this peak is much larger than the angle of 5° (a peak shape is dull). In this manner, the crystallinity of each Pt particle contained in the Pt layer constituting the resistance layer 120 is greatly improved in the present embodiment as compared to the comparative example.

It is obvious that the invention can be variously modified from the above description of the invention. It is difficult to regard that such modifications depart from a gist and a scope of the invention, and all the improvements obvious to those skilled in the art are included in the following claims.

REFERENCE SIGNS LIST

1 . . . micro-channel plate (MCP); 2 . . . channeltron; 12 . . . channel; 100 . . . substrate; 101 . . . channel formation surface; 110 . . . secondary electron emitting layer; 111 . . . secondary electron emitting surface; 120 . . . resistance layer; 121 . . . Pt particle (metal particle); 130 . . . underlying layer; and 140 . . . layer formation surface.

The invention claimed is:

1. An electron multiplier comprising:

a substrate having a channel formation surface;

a secondary electron emitting layer having a bottom surface facing the channel formation surface, and a secondary electron emitting surface which opposes the bottom surface and emits a secondary electron in response to incidence of a charged particle; and a resistance layer sandwiched between the substrate and the secondary electron emitting layer, the resistance layer including a Pt layer two-dimensionally formed on a layer formation surface which is coincident with or substantially parallel to the channel formation surface, wherein the resistance layer has a temperature characteristic within a range in which a resistance value of the resistance layer at −60° C. is 10 times or less, and a resistance value of the resistance layer at +60° C. is 0.25 times or more, relative to a resistance value of the resistance layer at a temperature of 20° C.

2. The electron multiplier according to claim 1, wherein the resistance layer has a temperature characteristic within a range in which a resistance value of the resistance layer at −60° C. is 2.7 times or less, and a resistance value of the resistance layer at +60° C. is 0.3 times or more, relative to a resistance value of the resistance layer at a temperature of 20° C.

3. The electron multiplier according to claim 1, wherein the Pt layer includes a Pt particle having crystallinity to such an extent that a peak on a (111) plane and a peak on a (200) plane at which a full width at half maximum is an angle of 5° or less appear in a spectrum obtained by XRD analysis.

4. The electron multiplier according to claim 3, wherein the Pt layer includes the Pt particle having crystallinity to such an extent that a peak on a (220) plane at which a full width at half maximum is an angle of 5° or less further appears in a spectrum obtained by XRD analysis.

5. The electron multiplier according to claim 1, further comprising an underlying layer provided between the substrate and the secondary electron emitting layer and having the layer formation surface at a position facing the bottom surface of the secondary electron emitting layer.

* * * * *